US005893481A

United States Patent [19]

Favre

[11] Patent Number: 5,893,481

[45] Date of Patent: Apr. 13, 1999

[54] BOX WITH ASSISTED OPENING

[75] Inventor: Bernard Favre, Chevilly Larue, France

[73] Assignee: Lir France, Chevilly Larue, France

[21] Appl. No.: 08/960,038

[22] Filed: Oct. 29, 1997

[30] Foreign Application Priority Data

Nov. 5, 1996 [FR] France ..... 96 13445

[51] Int. Cl.[6] ..... B65D 43/24

[52] U.S. Cl. ..... 220/831; 220/833; 220/844

[58] Field of Search ..... 220/264, 335, 220/827, 829, 831, 832, 833, 844

[56] References Cited

FOREIGN PATENT DOCUMENTS 0 548 457 6/1993 European Pat. Off. .

0 570 299 11/1993 European Pat. Off. .

2 683 798 5/1993 France .

2 689 100 10/1993 France .

2 725 958 4/1996 France .

*Primary Examiner*—Stephen K. Cronin

*Attorney, Agent, or Firm*—Young & Thompson

[57] ABSTRACT

A box (1) for cosmetic products, comprises a base (3) and a cover (2) articulated on an edge of the base (3) and having a closure joint. At the level of the hinge of the box (1), the cover (2) has at least one resilient tongue (6) projecting into the hinge, this resilient tongue (6) bearing with resilient deformation on the base (3) during closing of the box (1).

4 Claims, 2 Drawing Sheets

FIG.1
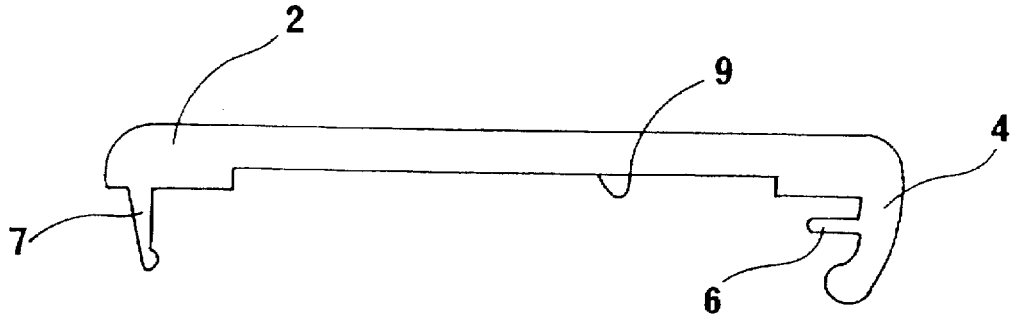
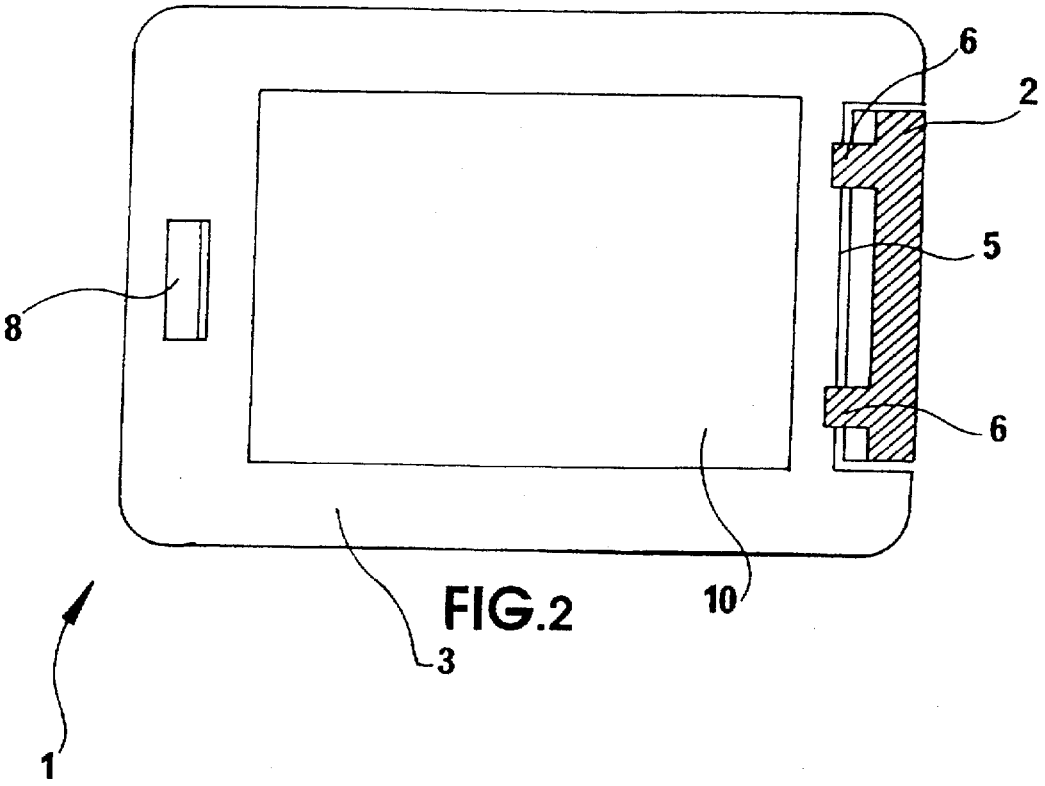
FIG.2

BOX WITH ASSISTED OPENING

This application corresponds to French application 96 13445 of Nov. 5, 1996, the disclosure of which is incorporated herein by reference.

FIELD OF THE INVENTION

The present invention relates to a box, particularly for cosmetic products, of the type comprising a base and a cover articulated on an edge of said base and having a closure that assists in its opening.

BACKGROUND OF THE INVENTION

Known boxes of this type have closure means disposed adjacent the hinge, known per se, and which permit the closing of the cover on the base and the maintenance of the cover in open position relative to the base. However, for this type of box, the opening of the box often gives rise to difficulties to the extent the user must have at least the possibility of inserting, for example, a fingernail into the joint plane between the cover and the base opposite the hinge of the box to open the latter.

THE KNOWN PRIOR ART

There is known from FR-A-2 689 100, a box of the type comprising a base and a cover articulated on the edge of the base in which there is used an articulation mechanism comprising at least one resiliently deformable articulation rod. The articulation mechanism comprises moreover means giving rise to the deformation of said articulation rod during closing of the box so as to store up resilient reaction force and means to transform said resilient reaction force into a pivoting force for the cover during opening of the box.

Thus, first means are constituted by elements provided in the hinge so as to form an abutment, said abutting members being provided to give rise to displacement of the cover relative to the base during closure of the box so as to deform the articulation rod.

The second means can be, for example, in the form of a tongue that is resiliently deformable during closing of the box and whose deformation imposes a pivoting movement on the cover during opening, transforming the resilient deformation force of the articulation rod into a pivoting force.

This document proposes a box provided with opening assistance but requires a relatively complicated construction of the box and hence is costly to use.

FR-A-2 725 958 discloses a box whose closing assists in its opening. This box comprises a base and a cover articulated on the edge of the base which has at the level of the hinge at least one flexible tongue against which a rigid protuberance provided on the cover facing said tongue comes into abutment, such that during closure of the box, the protuberance comes into abutment against the tongue which deforms. During opening of the box, the tongue tends to push back the protuberance and thus impresses a pivoting movement on the box. Here again, it is necessary to give to the box a particular structure.

SUMMARY OF THE INVENTION

The present invention provides a box of the type of the above boxes, which permits obtaining a pre-opening of the box whilst maintaining a simple structure of the box.

To this end, the invention has for its object a box, in particular for cosmetic products, of the type comprising a base and a cover articulated on an edge of said base and having a jointed closure, characterized in that, at the level of the hinge of the box, the cover has at least one resilient tongue projecting into the hinge, said resilient tongue coming to bear with resilient deformation, against the base, during closing of the box.

In a manner known per se, the cover, at the level of the hinge, has a portion of the wall which is longer and is inscribed in a recess provided in the base so as to constitute the hinge. Preferably, the elastic tongue extends within the interior of the hinge to the portion of the wall prolonged by the cover, substantially perpendicular to the latter, such that in the closed position of the box, the resilient tongue projects above the plane of the joint of the box.

Thus, preferably, the resulting deformation of application of the elastic tongue against the base during closing of the box give rise, during opening of the box, to a resilient reaction force resulting in a pre-opening effect of the box.

Because of this resilient reaction force, the resilient tongue has the tendency to space itself from the base against which it bears and this gives rise to easy pivoting of the cover relative to the base.

Moreover, the localization of the resilient tongue in the hinge recess permits producing the elastic tongue with a length sufficient to obtain distribution of the deformation exerted on the tongue during closure without the elastic limit of the resilient tongue being exceeded. There is thus obtained a better restoration of the elastic reaction force accumulated during closing of the box and suitable to give rise to the pivoting of the cover relative to the base during opening of the box.

BRIEF DESCRIPTION OF THE DRAWINGS

The invention will now be described in greater detail with reference to the accompanying drawings, in which:

FIG. 1 is a side cross-sectional view of the cover of a box according to the invention;

FIG. 2 shows in cross-sectional view the box according to the invention, the cross section being taken on the plane of the joint.

DETAILED DISCLOSURE OF THE INVENTION

Figure 3:
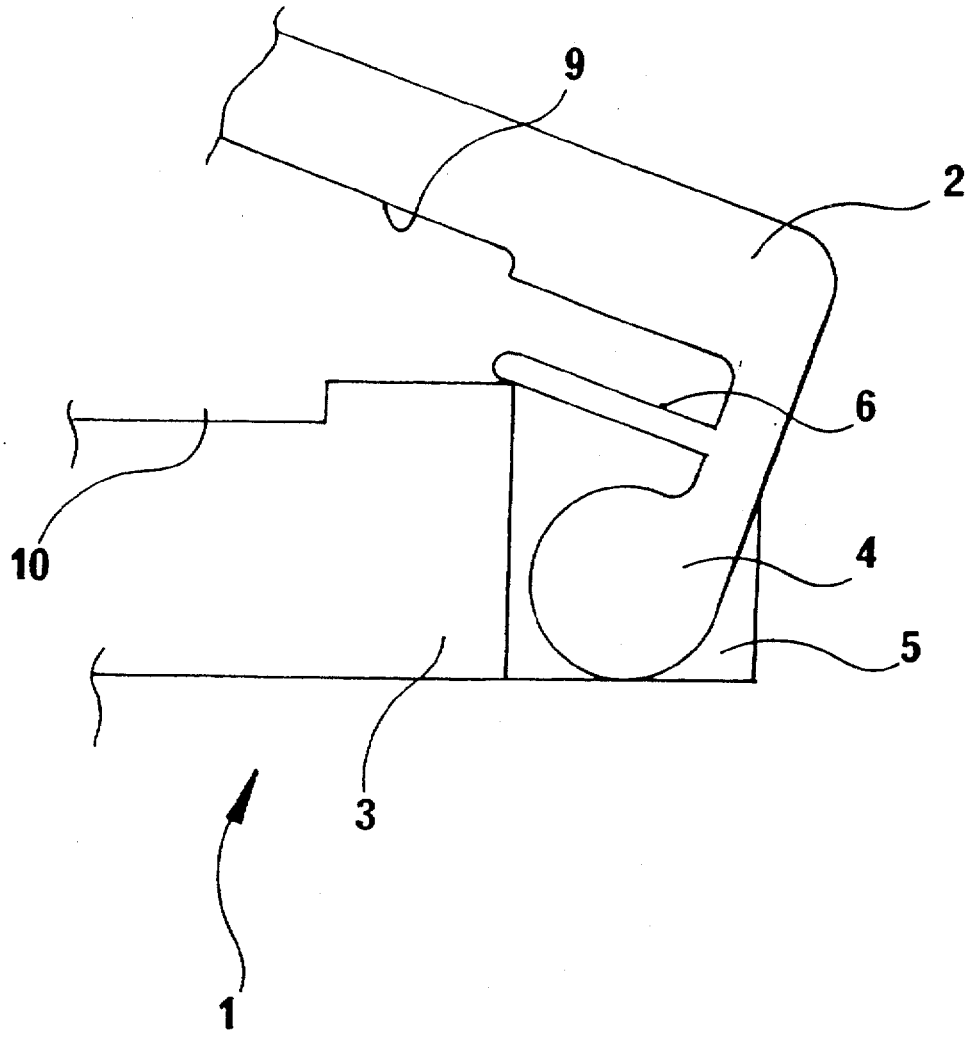
FIG. 3 is an enlarged cross-sectional view of the hinge of the box of FIG. 2.

A box according to the invention comprises a cover 2 mounted pivotally on the edge of a base 3. In the described example, the box 1 has a rectangular form but any shape of box is also within the scope of the invention.

The rear edge 4 of the cover 2 is prolonged so as to come into engagement with a recess 5 provided on the rear edge of the base 3 and so as to constitute a hinge. The articulated securement between the base 3 and the cover 2 is carried out by any known means of the bore and hinge rod type.

Along the rear edge 4 of the cover 2 are formed two resilient tongues 6 which project substantially perpendicular to the rear edge 4, toward the interior of the hinge.

These resilient tongues 6 are formed such that during closing of the box, said resilient tongues 6 project from the plane of the joint 7 of the box 1.

Thus, when the box 1 is closed, the resilient tongues 6 come to bear with resilient deformation against the base 3, which induces a resilient reaction force in the tongues 6 such that during opening of the box 1, said resilient reaction force effects a pre-opening of the box 1, the accumulated force giving rise to the pivoting of the cover 2 relative to the base 3.

Moreover, the cover 2 and the base 3 are made in the usual manner and comprise respectively compartments 9 and 10 suitable to receive, in the compartment 9, in the cover 2, a mirror, and in the compartment 10, in the base 3, a shallow basin containing a cosmetic product.

The box 1 also has complementary snap means and unsnapping means, known per se, and provided respectively on the cover 2 and on the base 3 opposite the hinge.

What is claimed is:

1. In a box for cosmetic products, comprising a base (3) and a cover (2) articulated on an edge of the base (3) and having a closure joint; the improvement in which the cover (2) has at least one resilient tongue (6) formed integrally thereon of the same material as and of one piece with the cover, said resilient tongue (6) coming to bear with resilient deformation against the base (3) during closing of the box (1).

2. In a box for cosmetic products, comprising a base (3) and a cover (2) articulated on an edge of the base (3) and having a closure joint; the improvement in which the cover (2) has at least one resilient tongue (6) thereon extending in a direction inwardly of the cover parallel to the cover and terminating in a free end portion that bears with resilient deformation against the base (3) during closing of the box (1).

3. In a box for cosmetic products, comprising a base (3) and a cover (2) articulated on an edge of the base (3) and having a closure joint; the improvement in which the base (3) has a recess (5) therein in which the cover (2) is swingably mounted by means of a hinge (4), and the cover (2) has at least one resilient tongue (6) thereon that is disposed in said recess and bears with resilient deformation against the base (3) during closing of the box (1).

4. A box as claimed in claim 3, wherein said hinge has a pivot axis disposed at a substantially lower level than said joint.

* * * * *